US009074812B2

(12) United States Patent
Rowland

(10) Patent No.: US 9,074,812 B2
(45) Date of Patent: Jul. 7, 2015

(54) DRAIN PAN WITH INTEGRATED RISER

(75) Inventor: Jay F. Rowland, Duluth, GA (US)

(73) Assignee: J.F.R. Enterprises, Inc., Johns Creek, GA (US)

( * ) Notice: Subject to any disclaimer, the term of this patent is extended or adjusted under 35 U.S.C. 154(b) by 321 days.

(21) Appl. No.: 11/320,992

(22) Filed: Dec. 29, 2005

(65) Prior Publication Data

US 2006/0144071 A1 Jul. 6, 2006

Related U.S. Application Data

(60) Provisional application No. 60/640,332, filed on Dec. 30, 2004.

(51) Int. Cl.
*F25D 21/14* (2006.01)
*F24F 13/22* (2006.01)

(52) U.S. Cl.
CPC ..... *F25D 21/14* (2013.01); *F24F 13/222* (2013.01); *F25D 2500/02* (2013.01)

(58) Field of Classification Search
USPC ..... 62/285, 291, 498, 150, 272, 281, 286, 62/288, 290; 184/106; 220/570, 571, 220/571.1, 573, 573.1; 261/29; 177/238; 165/173, 178; 137/1, 15.01, 15.11, 312
See application file for complete search history.

(56) References Cited

U.S. PATENT DOCUMENTS

| | | | | |
|---|---|---|---|---|
| D32,575 | S | | 4/1900 | Stevenson |
| 1,487,065 | A | | 3/1924 | Irons |
| 1,584,175 | A | | 5/1926 | Irons |
| 1,915,849 | A | | 6/1933 | Crimmel et al. |
| 2,544,743 | A | | 3/1951 | Vrabcak |
| 2,934,003 | A | | 4/1960 | Ladymon |
| 3,318,107 | A | | 5/1967 | Riley |
| 3,367,132 | A | | 2/1968 | Elliott |
| 3,480,178 | A | | 11/1969 | Morgan |
| 3,724,233 | A | | 4/1973 | Pugh et al. |
| 3,788,581 | A | | 1/1974 | Rutzick |
| 3,790,115 | A | | 2/1974 | Fox et al. |
| 3,848,546 | A | | 11/1974 | Lawlor |
| 3,888,090 | A | * | 6/1975 | Meyer ..... 62/240 |
| 4,050,659 | A | | 9/1977 | McCannon et al. |
| 4,243,197 | A | | 1/1981 | Wright |

(Continued)

FOREIGN PATENT DOCUMENTS

| | | |
|---|---|---|
| AU | 2006100199 A4 | 4/2006 |
| DE | 2650288 | 5/1978 |

(Continued)

OTHER PUBLICATIONS

Non-final Office Action and Notice of References cited for U.S. Appl. No. 11/833,298, mailed Dec. 23, 2009.

(Continued)

*Primary Examiner* — Mohammad M Ali
*Assistant Examiner* — Emmanuel Duke
(74) *Attorney, Agent, or Firm* — Sutherland Asbill & Brennan LLP

(57) ABSTRACT

A drain pan for an air handling unit including a base, a lip attached to the base wherein the lip extends substantially vertically from the base, and a riser affixed to the base wherein the riser extends substantially vertically from the base to support the air handling unit. The drain pan may further include a riser that is preformed with the base to form a unibody drain pan.

14 Claims, 4 Drawing Sheets

(56) References Cited

U.S. PATENT DOCUMENTS

| | | | | | |
|---|---|---|---|---|---|
| D262,104 | S | | 12/1981 | Simpson | |
| D271,328 | S | | 11/1983 | Lanier et al. | |
| 4,480,748 | A | | 11/1984 | Wind | |
| 4,484,661 | A | | 11/1984 | Evenson | |
| 4,604,874 | A | * | 8/1986 | Seeley | 62/298 |
| 4,644,753 | A | | 2/1987 | Burke | |
| 4,653,651 | A | | 3/1987 | Flum | |
| 4,687,604 | A | * | 8/1987 | Goettl | 261/29 |
| 4,733,790 | A | | 3/1988 | Stein | |
| 4,783,971 | A | * | 11/1988 | Alba | 62/291 |
| 4,814,752 | A | | 3/1989 | Lehman | |
| 4,835,984 | A | | 6/1989 | Vyavaharkar | |
| 4,869,456 | A | | 9/1989 | Jacobs | |
| 4,917,581 | A | | 4/1990 | Richardson | |
| D308,247 | S | | 5/1990 | Adam | |
| 4,930,632 | A | | 6/1990 | Eckert | |
| D309,571 | S | | 7/1990 | Lehman | |
| 5,076,534 | A | | 12/1991 | Adam | |
| 5,147,039 | A | * | 9/1992 | Sechler et al. | 206/386 |
| 5,224,508 | A | * | 7/1993 | Bates, Jr. | 137/312 |
| 5,230,601 | A | * | 7/1993 | Apps et al. | 414/801 |
| 5,249,699 | A | | 10/1993 | Williams | |
| 5,307,931 | A | | 5/1994 | Gillispie | |
| D353,665 | S | * | 12/1994 | Jennings | D23/363 |
| 5,392,944 | A | | 2/1995 | Jennings | |
| 5,429,236 | A | | 7/1995 | Evans | |
| D368,409 | S | | 4/1996 | Schwartz | |
| 5,791,156 | A | * | 8/1998 | Strautman et al. | 62/244 |
| D399,095 | S | | 10/1998 | Schmidt | |
| 5,848,536 | A | * | 12/1998 | Dodge et al. | 62/240 |
| 5,881,566 | A | * | 3/1999 | Shacklock et al. | 62/277 |
| 5,961,093 | A | | 10/1999 | Jones | |
| 5,966,958 | A | * | 10/1999 | Maynard | 62/277 |
| 6,044,592 | A | | 4/2000 | Strieter | |
| 6,065,531 | A | | 5/2000 | Schneider | |
| D426,110 | S | | 6/2000 | Schmidt | |
| 6,112,536 | A | | 9/2000 | Hansen | |
| D431,958 | S | | 10/2000 | Harris | |
| 6,125,647 | A | | 10/2000 | Martinez | |
| 6,286,328 | B1 | | 9/2001 | Kawahara | |
| 6,360,911 | B1 | * | 3/2002 | Arnold | 220/571 |
| 6,382,108 | B1 | * | 5/2002 | Stanek et al. | 108/55.1 |
| 6,718,788 | B1 | * | 4/2004 | Shuck | 62/291 |
| 6,766,615 | B2 | * | 7/2004 | Smead | 47/71 |
| 6,797,894 | B2 | * | 9/2004 | Montagnino et al. | 177/238 |
| 6,868,689 | B1 | * | 3/2005 | McNeil et al. | 62/285 |
| 6,895,770 | B1 | * | 5/2005 | Kaminski | 62/285 |
| 6,978,909 | B2 | | 12/2005 | Goetzinger | |
| D590,123 | S | | 4/2009 | Hermans | |
| D590,124 | S | | 4/2009 | Hermans | |
| D590,572 | S | | 4/2009 | Hermans | |
| D590,573 | S | | 4/2009 | Hermans | |
| D600,874 | S | | 9/2009 | Hermans | |
| D600,875 | S | | 9/2009 | Hermans | |
| D608,917 | S | | 1/2010 | Ward et al. | |
| 2002/0000093 | A1 | * | 1/2002 | Lea | 62/150 |
| 2008/0029684 | A1 | | 2/2008 | Rowland | |
| 2010/0207004 | A1 | | 8/2010 | Hermans et al. | |

FOREIGN PATENT DOCUMENTS

| | | | | | |
|---|---|---|---|---|---|
| KR | 1020040020748 | | * | 3/2004 | F24F 1/02 |
| KR | 200402748 | | * | 9/2004 | F24F 1/02 |
| WO | WO0039512 | | | 6/2000 | |
| WO | 03064239 | A1 | | 8/2003 | |
| WO | 2007068036 | | | 6/2007 | |

OTHER PUBLICATIONS

Final Office Action for U.S. Appl. No. 11/833,298, mailed Jun. 24, 2010.

Advisory Action for U.S. Appl. No. 11/833,298 mailed Aug. 26, 2010.

* cited by examiner

DRAIN PAN WITH INTEGRATED RISER

RELATED APPLICATION DATA

The present application claims benefit of U.S. Provisional Application No. 60/640,332, entitled "Drain Pan with Integrated Riser," filed on Dec. 30, 2004.

TECHNICAL FIELD

The present invention relates generally to the field of drain pans and more particularly relates to a drain pan with an integrated riser.

BACKGROUND OF THE INVENTION

Air handling units, such as air conditioners, create condensation during operation. For instance, typical air conditioning units include a compressor and an evaporator including evaporator coils. The expansion process in the evaporator cools the evaporator coils. Air is cooled by being passed over the evaporator coils.

As the air passes over the evaporator coils, water may condense on the coils and drip from the coils. A primary drip pan and drain are installed under the evaporator coils to collect and drain the condensate. As a precautionary matter, a secondary drain pan is often installed beneath the air handling unit to secure any excess drainage not caught by the primary drip pan and drain.

Typically, a secondary drain pan is made of plastic or metal and is rectangularly shaped. The drain pans being used currently have a base and a lip for holding the condensate. Bricks, cinder blocks, wood, or other structures are often placed in the drain pan for supporting the air handling unit above the base of the drain pan by the installer of the air handling unit. The supports or risers are often found at the work site and are not precise in dimension. Therefore, installers of air handling units waste time and effort locating support structures to place in the drain pan and positioning those structures to support adequately the air handling unit.

Thus, there is a need in the art for a secondary drain pan that includes an integrated riser for supporting the air handling unit.

SUMMARY OF THE INVENTION

In one aspect of the application, a drain pan for an air handling unit includes a base, a lip attached to the base, wherein the lip extends substantially vertically from the base; and a riser affixed to the base, wherein the riser extends substantially vertically from the base to support the air handling unit. In one embodiment, the riser is preformed with the base to form a unibody drain pan.

In another embodiment, the riser includes a number of legs. The plurality of legs may be in a substiantially X shaped configuration. In other embodiments, the legs of the riser are in substantially rectangular or triangular configurations. In yet another embodiment, the drain pan may include a plurality of risers. The risers may be oriented in a substantially parallel position.

In another embodiment, the riser may be a substantially pyramidal shape or a substantially rectangular shape. In yet another embodiment, the riser may include a plurality of ribs to add support to the riser. In still yet another embodiment, the riser may be substantially hollow. A plurality of risers may be stacked using the substantially hollow space in the riser. In another embodiment, the lip may be attached to edges of the base.

In another embodiment, the drain pan is made of plastic or metal. In yet another embodiment, the drain pan may include a drainage pipe that allows fluid to flow out of the drain pan. The drainage pipe may interface the base of the drain pan through the lip.

In another aspect of the application, a method is provided for storing a plurality of drain pans. The method includes providing a first drain pan that has a base and a riser affixed to the base, wherein the riser extends substantially vertically from the base to support the air handling unit and has a substantially hollow space. The method further includes providing a second drain pan that has a base and a riser affixed to the base, wherein the riser extends substantially vertically from the base to support the air handling unit and is substantially hollow, and stacking the first drain pan on the second drain pan such that the riser of the second drain pan fits into the hollow space of the first drain pan.

BRIEF DESCRIPTION OF THE DRAWINGS

FIG. 3*a* is a perspective view of a drain pan with a plurality of integrated risers according to an embodiment of the application.

DETAILED DESCRIPTION

The present application now will be described more fully hereinafter with reference to the accompanying drawings, in which several embodiments of the application are shown. This application may, however, be embodied in many different forms and should not be construed as limited to the embodiments set forth herein; rather, these embodiments are provided so that this disclosure will be thorough and will fully convey the scope of the application to those skilled in the art. Like numbers refer to like elements throughout.

Figure 1:
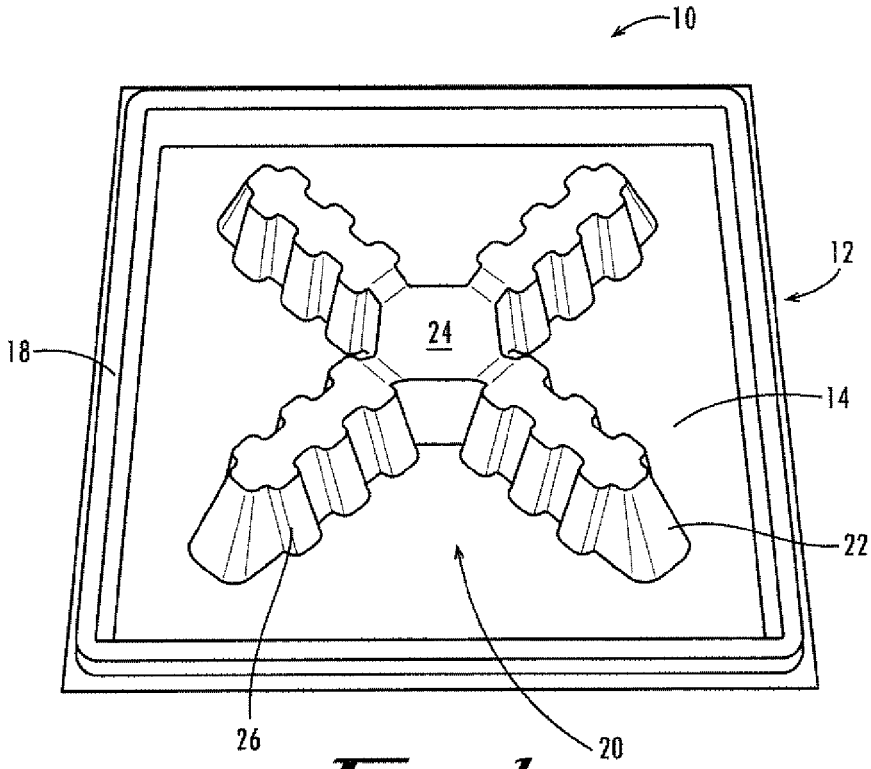
FIG. 1 is a perspective view of a drain pan with integrated riser according to an embodiment of the application.
Figure 2:
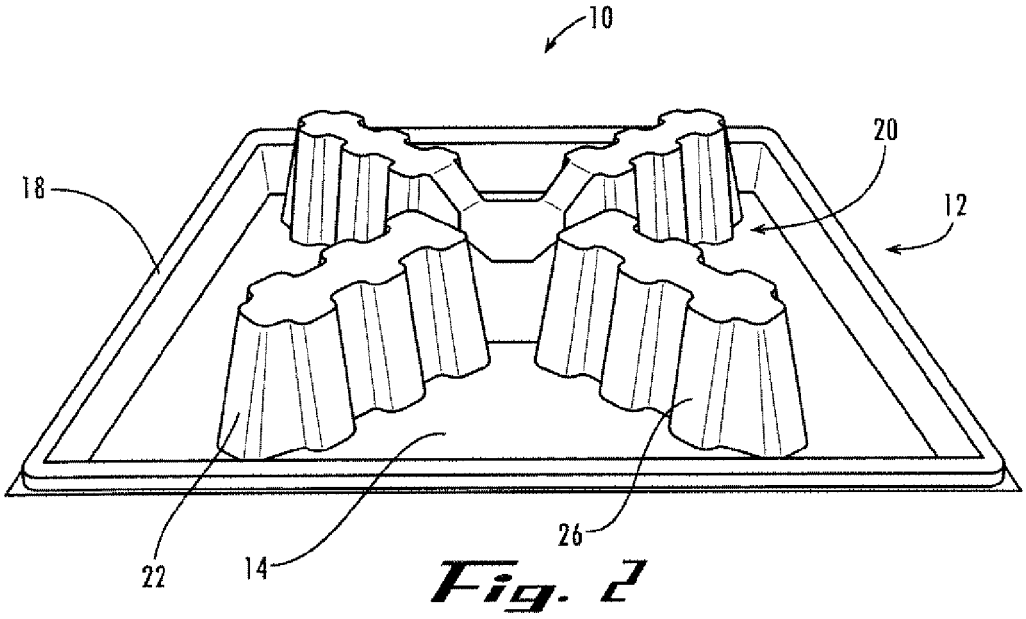
FIG. 2 is a perspective view of a drain pan with integrated riser according to an embodiment of the application.
Figure 1A:
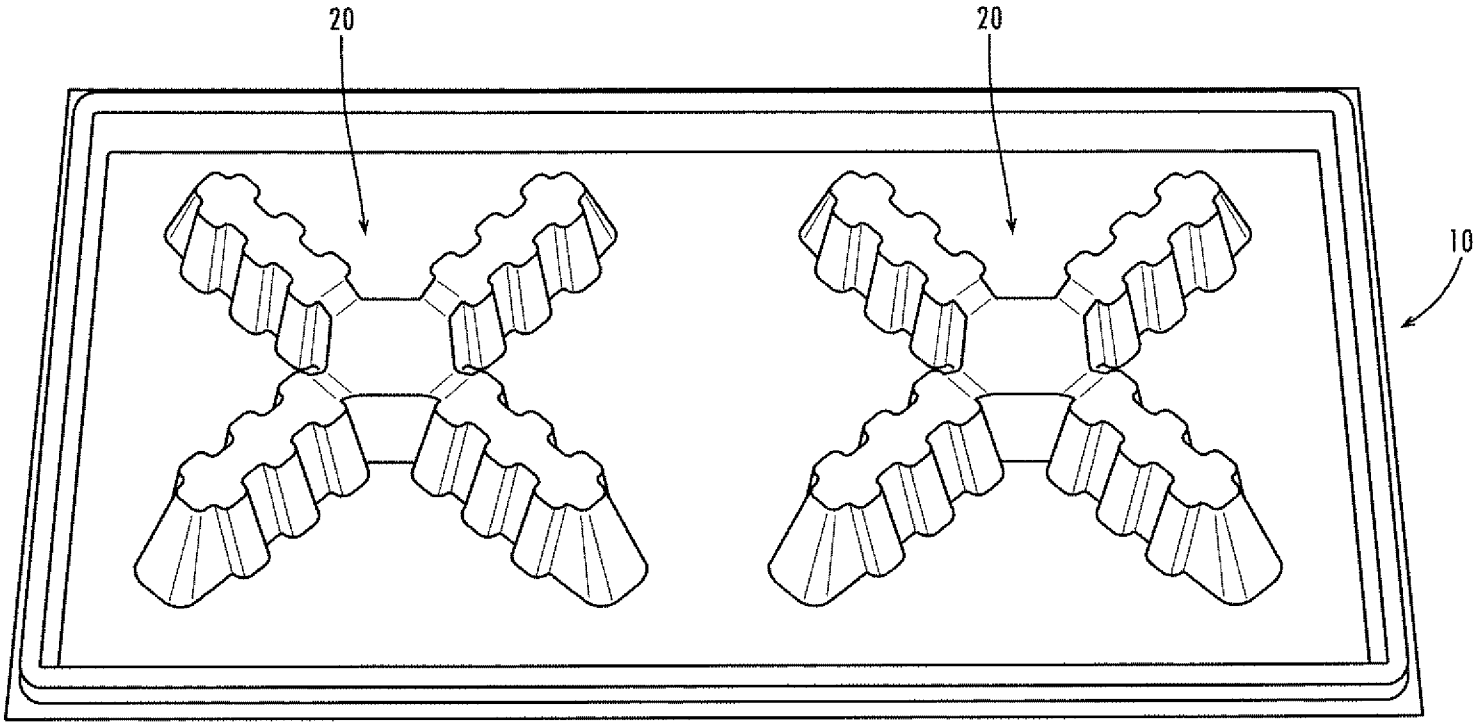

FIGS. 1 and 2 illustrate an embodiment of the drain pan 10. The drain pan 10 includes a base 12, a top surface 14 of the base, and a bottom surface 16 of the base. The base may be any shape adequate for use with an air handling unit. It will be appreciated that the drain base may be rectangular, square, circular, polygonal, or any other shape.

The drain pan 10 may be made of any material with suitable weight and strength requirements including but not limited to plastic, metal, or ceramics. The drain pan 10 also should be made of a material suitable for use in high heat environments. For example, the drain pan 10 may be used in temperatures in excess of 140° F. in uses such as an attic. The metal may include steel, aluminum, or any other suitable metal. In an exemplary embodiment, the drain pan 10 is made of plastic with a thickness of approximately one quarter of an inch. One of ordinary skill in the art will appreciate that the drain pan 10 is not limited to plastic and the thickness is not limited to one quarter of an inch.

Furthermore, the drain pan 10 may be any size suitable for use under an air handling unit. Typical drain pans have dimensions in the range of approximately 14×48 inches to 38×62 inches. One of ordinary skill in the art will appreciate that the drain pan 10 is not limited to these dimensional ranges and may be any size necessary to accommodate any air handling unit. In another embodiment, the drain pan 10 may be located beneath any other device or structure attached to or positioned under the air handler such as a humidifier, sheet metal, plenum or any other device or structure.

The drain pan 10 further includes a lip 18 extending substantially vertically from the top surface 14 of the base. In an exemplary embodiment, the lip 18 extends from the edges of the top surface 14 of the base. It will be appreciated by one of ordinary skill in the art that the lip 18 may extend from any portion of the base and is not limited to the edges of the base. In an exemplary embodiment, the lip 18 extends approximately two inches from the top surface 14 of the base. Any lip tall enough to hold liquid drainage without spillage is contemplated herein. It will also be appreciated by one of ordinary skill in the art that the lip 18 does not have to intersect the top surface 14 of the base at a right angle. For example, the lip may be angled, have an angled intermediate lip, or include a beveled portion that intersects the top surface 14 of the base.

A riser 20 extends from the top surface 14 of the base. The riser 20 extends substantially vertically from the top surface 14 of the base 12 such that a top of the riser 20 is positioned vertically higher than a top of the lip 18. In an exemplary embodiment, the riser 20 extends approximately 3.75 inches from the top surface 14 of the base. One of ordinary skill in the art will appreciate that the riser 20 may be any height that extends above the top of the lip 18.

The riser 20 may be positioned at any location on the top surface 14 of the base. In an exemplary embodiment, the riser 20 is positioned in substantially the center of the top surface 14 of the base. It will be appreciated by one of ordinary skill in the art that the position of the riser is not limited to the center of the base but may be off-center including on the periphery of the top surface of the base, the comers of the base, or any other suitable location.

The drain pan 10 also may include at least two risers 20. The risers 20 may be positioned in any configuration adequate for supporting an air handling unit. In one embodiment, the drain pan 10 includes two risers 20 each positioned on opposite sides of the top surface 14 of the base. In another embodiment, the drain pan 10 includes four risers 20 each positioned in a corner of the top surface 14 of the base. One of ordinary skill in the art will appreciate that any number of risers is contemplated herein and that the risers may be positioned in any configuration on the top surface of the base.

Figure 3B:
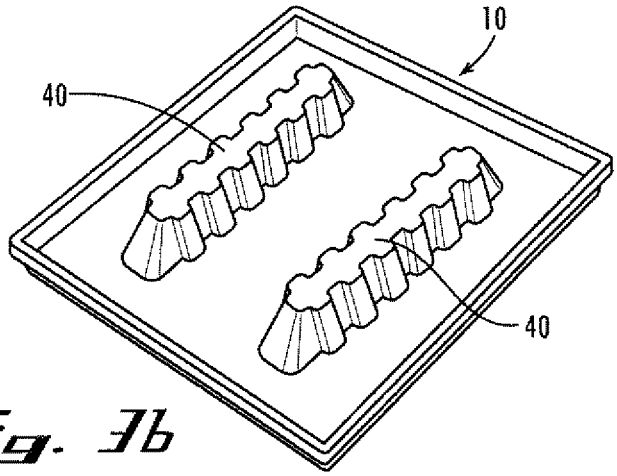
FIG. 3*b* is a perspective view of a drain pan with a plurality of integrated risers according to an embodiment of the application.

The riser 20 may be of any shape that is adequate for supporting an air handling unit. In an exemplary embodiment, the riser 20 includes legs 22 which create a substantially "X" configuration. In another aspect of the embodiment, each of the legs 22 of the "X" configuration of the riser 20 are shaped substantially pyramidal. It will be appreciated by one of ordinary skill in the art that the legs of the riser may be any shape including rectangular, triangular, conical, or any other shape. Further, the riser 20 may include other support structures to assist in the supporting of the air handling unit. In an exemplary embodiment, a substantially square support structure 24 resides between the legs of the riser for added support. In an exemplary embodiment illustrated in FIG. 3*a*, the drain pan 10 includes two sets of risers configured in a substantially "X" shaped configuration positioned on opposite ends of the top surface 14 of the base.

Figure 4:
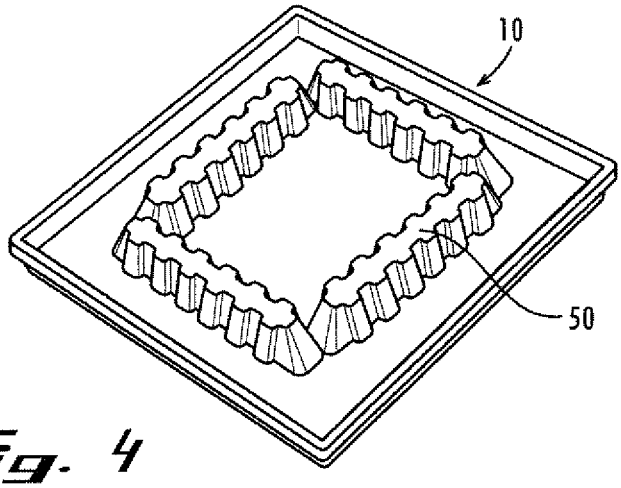
FIG. 4 is a perspective view of a drain pan with integrated riser in a rectangular configuration according to an embodiment of the application.
Figure 5:
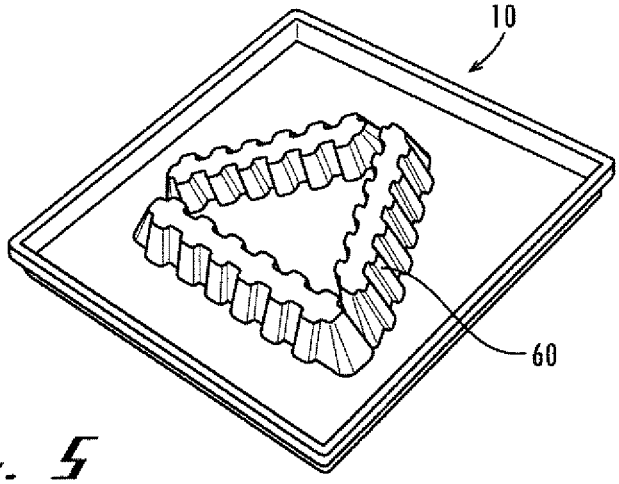
FIG. 5 is a perspective view of a drain pan with integrated riser in a triangular configuration according to an embodiment of the application.

The riser 20 is not limited to the "X" configuration. One of ordinary skill in the art will appreciate that the legs of the riser 20 may be positioned in any configuration including substantially rectangular, square, circular, oval, pyramidal or any other configuration that provides sufficient support to air handling units. In an exemplary embodiment illustrated in FIG. 3*b*, the drain pan 10 includes two substantially rectangular shaped risers 40 positioned on opposite sides of the top surface 14 of the base. In another exemplary embodiment shown in FIG. 4, the drain pan 10 includes a riser 50 positioned in a substantially rectangular position. In yet another exemplary embodiment shown in FIG. 5, the drain pan 10 includes a riser 60 positioned in a substantially triangular position.

The riser 20 may be substantially hollow or solid. The hollow riser provides a lighter drain pain than would a solid riser. In one embodiment, the legs 22 of the riser 20 further include ribs 26 for added support to the riser. It is contemplated that the ribs 26 are not necessary if the riser 20 can provide sufficient support without the ribs 26.

The riser 20 is affixed to the base 12 of the drain pan 10. In an exemplary embodiment, the riser 20 is preformed with the base 12 of the drain pain 10 as a unibody structure. The formation of the unibody drain pan may be manufactured through the use of molds or any other manufacturing technique. In another embodiment, the riser 20 and the base 12 are formed separately and the riser 20 is then affixed to the top surface 14 of the base of the drain pan.

Figure 6:
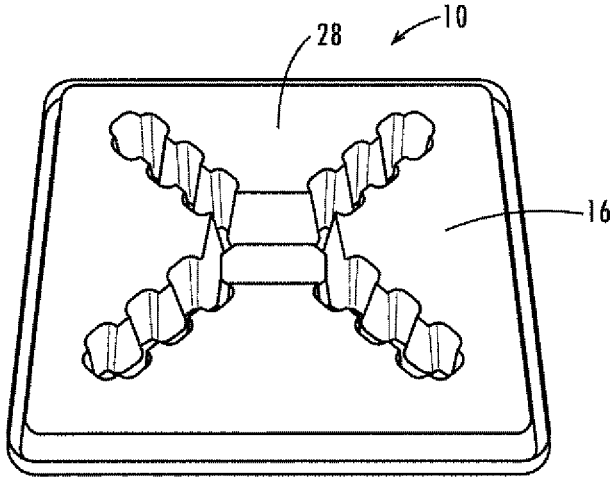
FIG. 6 is a perspective view of the bottom surface of a drain pan with a hollow riser.
Figure 7:
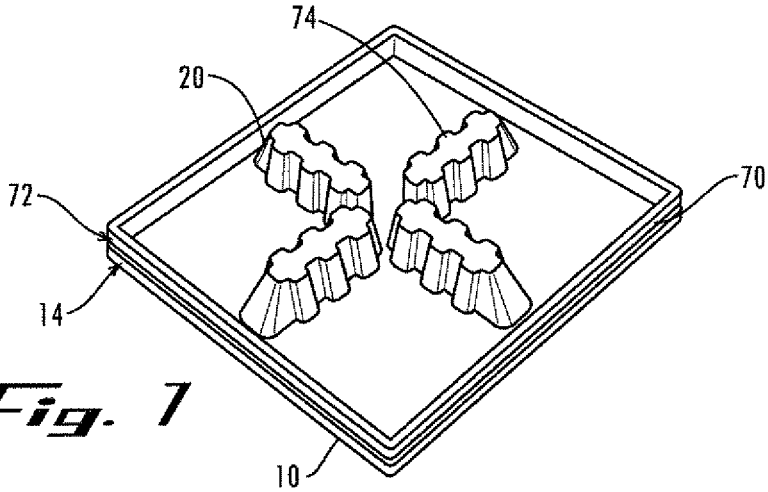
FIG. 7 is a perspective view of a first drain pan with integrated riser stacked with a second drain pan with integrated riser according to an embodiment of the application.

FIG. 6 illustrates an embodiment of the drain pan 10 with the hollow riser 20. The bottom surface 16 of the base provides openings 28 aligned with the riser 20. As shown in FIG. 7, the openings 28 allow a plurality of drain pans of the same configuration to be stacked together. The plurality of drain pans may be stacked by interfacing the top surface 14 of the base and riser 20 of a first drain pan 10 with a bottom surface 72 of a base and a riser 74 of a second drain pan 70. The stackable utility of the drain pan 10 allows a plurality of drain pans to be stacked together to aid in shipping, retail, or distribution of the drain pans.

Figure 8:
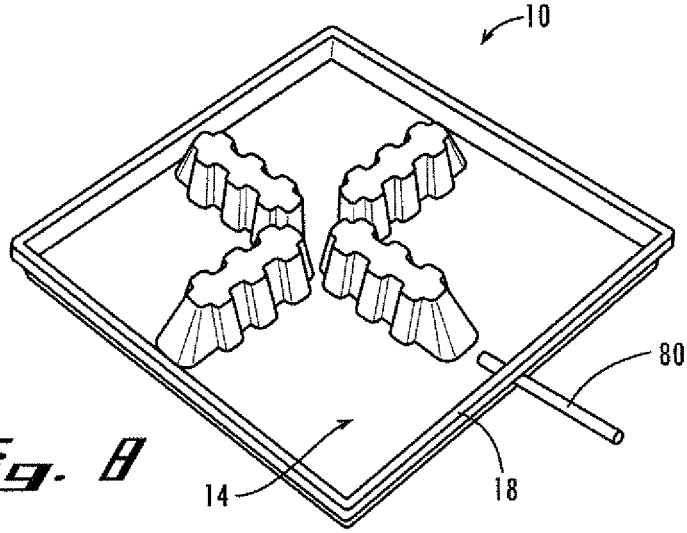
FIG. 8 is a perspective view of a drain pan with integrated riser with a drainage pipe according to an embodiment of the application.

The drain pan 10 may be used as a secondary drain pan for air handling units. The drain pan 10 may be placed beneath the air handling unit to support the air handling unit and to receive any drainage not accumulated in the primary drain pan. The riser 20 on the drain pan 10 may be used to support the air handling unit such that the air handling unit rests on the riser. One of ordinary skill in the art will appreciate that adhesive or cushion may be placed on top of the riser so that the adhesive or cushion resides between the riser and the air handling unit to further secure the air handling unit on the riser. In an exemplary embodiment, mastic adhesive is affixed to the top of the riser; however, any adhesive is contemplated herein. The drainage not accumulated in the primary drain pan would be secured in the base of the drain pan 10. The liquid drainage may be secured on the base 12 of the drain pan 10 by the lip 18. In an exemplary embodiment illustrated in FIG. 8, the drain pan 10 may include a drainage pipe 80. The drainage pipe 80 may interface the top surface 14 of the base or a location on the lip 18. The drainage pipe 80 may intersect the lip 18 to access the top surface 14 of the base. The drainage pipe may be used to remove excessive liquid drainage from the drain pan.

In another embodiment, the drain pan 10 may be used to collect drainage from an air handling unit but not support the air handling unit. For example, the drain pan 10 may be hung beneath the air handling unit in a non-load bearing capacity.

It should be apparent that the foregoing relates only to exemplary embodiments of the present application and that numerous changes and modifications may be made herein without departing from the spirit and scope of the application as defined herein.

I claim:

1. A secondary drain pan configured to be placed under an air handling unit to secure and drain any excess condensate that overflows from a primary drip pan of the air handling unit and to support the air handling unit apart from any drainage, the secondary drain pan comprising: a base; a lip extending upward from a perimeter of the base, the lip securing drainage on the base; at least two risers extending upward from the base and substantially across the base, each riser having riser portions comprising: side walls that extend upward from the base, a bottom of the side walls turning into the base such that an inner surface of the riser portions turns outward to form a bottom surface of the base; an upper support surface capable of supporting at least a portion of the air handling unit thereon, an outer surface of the side walls turning laterally inward to form the upper support surface; and at least one rib disposed along the side walls that increases load-bearing ability of the riser; and a supportive structure disposed between the riser portions, the supportive structure having less height than the riser support surfaces; wherein the upper support surface is wider at the at least one rib; wherein the riser portions about the at least one rib comprise a substantially frustoconical cross-section; wherein the riser portions connect at an angle such that the riser portions form one longer riser, wherein a distance between the risers varies along a length of the at least two risers; each riser enclosed from above and from the sides, limiting air or water from passing through the riser so that any drainage descends to the base, the upper support surfaces positioned above the lip to support the air handling unit above the lip and apart from any drainage on the base; wherein at least a portion of the side walls of each riser and at least one end of each riser tapers to the base such that drainage on the base may flow around the at least one end such that a drainage opening interfacing the base through the lip allows the drainage to flow freely out of the base; wherein the base, the lip, the at least one rib, and the risers are molded as a unibody drain pan with integrated support; wherein at least the risers are shaped to be nestably stackable with risers of another similarly shaped secondary drain pan; and wherein the riser portions comprise conical sharps, pyramidal sharps, rectangular sharps, triangular sharps, or a combination thereof.

2. The secondary drain pan of claim 1, wherein the secondary drain pan comprises plastic.

3. The secondary drain pan of claim 1, further comprising at least a third riser that extends upward from the base and extends across a center of the base.

4. The secondary drain pan of claim 3, wherein an upper support surface of the third riser is a different length than a length of the upper support surfaces of the at least two risers.

5. The secondary drain pan of claim 1, wherein the at least two risers are symmetrically opposed.

6. The secondary drain pan of claim 1, wherein the lip extends approximately two inches from the base and a base length is approximately twice a base width.

7. The secondary drain pan of claim 1, wherein at least portions of each riser originate from the same plane in the base.

8. A secondary drain pan configured to be placed under a condensate producing unit to secure and drain excess condensate that overflows from the condensate producing unit and to support the condensate producing unit, the secondary drain pan comprising:

a base;

a lip that extends upward from a perimeter of the base to secure drainage on the base;

at least two risers that extend upward from the base, each riser running substantially from one side of the base to the other side of the base, a distance between the at least two risers varying along a length of the at least two risers, each riser comprising:

side walls that extend upward from the base, an upper support surface capable of supporting at least a portion of the condensate producing unit, the upper support surface extending laterally inward from the side walls;

wherein at least a portion the side walls and at least one end of each riser tapers to the base such that drainage on the base surface may flow around the at least one end such that a drainage opening interfacing the base at any place on the lip near a top surface of the base allows that drainage to flow freely out of the base; and a plurality of ribs disposed along the side walls of the at least two risers, wherein the plurality of ribs increase drain pan strength; and a supportive structure disposed between the at least two risers, the supportive structure having less height than the riser support surfaces;

wherein the bottom of the riser is wider at the plurality of ribs;

wherein the at least two risers about the plurality of ribs comprise a substantially frustoconical cross-section;

wherein each riser is enclosed from above and from the sides, limiting air or water from passing through the riser so that any drainage descends to the base, the upper support surfaces positioned above the lip to support the condensate producing unit above the lip apart from any drainage on the base;

wherein at least the risers of the secondary drain pan are shaped to be nestably stackable with risers of another similarly shaped secondary drain pan;

wherein the base, the lip, the plurality of ribs, and the risers are molded as a unibody drain pan providing integrated support;

wherein the at least two risers comprise conical shapes, pyramidal shapes, rectangular shapes, triangular shapes, or a combination thereof.

9. The secondary drain pan of claim 8, further comprising at least a third riser that extends upward from the base and extends across a center of the base.

10. The secondary drain pan of claim 9, wherein an upper support surface of the third riser is a different length than a length of the upper support surfaces of the at least two risers.

11. The secondary drain pan of claim 8, wherein the at least two risers are symmetrically opposed.

12. The secondary drain pan of claim 8, wherein a distance between the risers at their ends is different than a distance between the risers at their centers.

13. The secondary drain pan of claim 8, wherein at least one of the risers begins at a first corner of the base, runs toward a center of the base, and then turns to a second corner of the base that is on the same side as the first corner.

14. The secondary drain pan of claim 8, wherein the lip extends approximately two inches from the base and a base length is approximately twice a base width.

* * * * *

UNITED STATES PATENT AND TRADEMARK OFFICE

CERTIFICATE OF CORRECTION

PATENT NO. : 9,074,812 B2
APPLICATION NO. : 11/320992
DATED : July 7, 2015
INVENTOR(S) : Jay Rowland It is certified that error appears in the above-identified patent and that said Letters Patent is hereby corrected as shown below:

In the Claims

At column 5, lines 53 and 54, please change “sharps” to -- shapes --.

Signed and Sealed this
Fifteenth Day of December, 2015

Michelle K. Lee

Michelle K. Lee
*Director of the United States Patent and Trademark Office*